US005713110A

United States Patent [19]

Covi et al.

[11] Patent Number: 5,713,110

[45] Date of Patent: Feb. 3, 1998

[54] ZIPPER CLOSURE WITH DECORATIVE STONES

[75] Inventors: Christian Covi, Fritzens; Werner Steinlechner, Jenbach, both of Austria

[73] Assignee: D. Swarovski & Co., Wattens, Austria

[21] Appl. No.: 723,923

[22] Filed: Oct. 1, 1996

[51] Int. Cl.[6] ..... A44B 19/00

[52] U.S. Cl. ..... 24/431; 24/405; 24/415

[58] Field of Search ..... 24/431, 415, 405, 24/381

[56] References Cited

U.S. PATENT DOCUMENTS

| | | | |
|---|---|---|---|
| D. 117,671 | 11/1939 | Kay . | |
| 1,658,392 | 2/1928 | Prentice et al. | 24/431 |
| 2,108,009 | 2/1938 | Miller et al. | 24/405 |
| 2,191,874 | 2/1940 | Winterhalter | 24/405 |
| 2,495,033 | 1/1950 | Sullivan . | |
| 2,720,015 | 10/1955 | Morin | 24/405 |
| 3,028,647 | 4/1962 | Greenberg . | |
| 4,635,325 | 1/1987 | Hoerkens | 24/431 |
| 4,922,585 | 5/1990 | Suzuki et al. . | |
| 4,987,658 | 1/1991 | Horita | 24/405 |

FOREIGN PATENT DOCUMENTS

| | | |
|---|---|---|
| 183046 | 2/1955 | Austria . |
| 1413576 | 11/1975 | United Kingdom . |

*Primary Examiner*—Victor N. Sakran

*Attorney, Agent, or Firm*—Wenderoth, Lind & Ponack

[57] ABSTRACT

A zipper closure comprises first and second rows of plastic teeth formed on first and second bands, each said band having an edge bead, said teeth having free ends and opposed back ends fixed to said bands. In said teeth close to said back ends of said teeth decorative stones are formed, each of said decorative stones having a tapered portion with a tip, said tip being directed to said respective band, and lying closer to said respective band as a tangent plane on said edge bead of said band, which tangent plane lies parallel to said band.

2 Claims, 1 Drawing Sheet

ZIPPER CLOSURE WITH DECORATIVE STONES

BACKGROUND OF THE INVENTION

1. Field of the invention

The invention relates to a zipper closure with decorative stones. More particularly this invention relates to a zipper closure comprising first and second rows of plastic teeth formed on first and second bands, each the band having an edge bead, the teeth having free ends and opposed back ends fixed to bands, decorative stones being formed in the teeth, each of the decorative stones having a tapered portion with a tip, the tip being directed towards the respective band.

2. Prior Art

As has been known for many years, it is possible to form plastic teeth directly on the bands of a zipper closure by injection molding (see U.S. Pat. No. 2,495,033 and U.S. Pat. No. 3,825,978). In the past, for providing these teeth with decorative stones, e.g. of lead crystal, such stones were glued into respective recesses in the teeth. Today the stones are inserted into an injection mold together with the respective band, and thereby are connected to the teeth during the process of injection molding the teeth. However, this known process is limited to zipper closures which are provided with decorative stones that are arranged close to the free ends of the teeth. In this region of a tooth which is close to its free end, the protrusions and recesses for the mutual engagement of the teeth have to be provided. This leads to serious restrictions in the possible shapes of the teeth and sizes of the stones.

From the U.S. Des. No. 117,671 it is principally known to arrange decorative stones on a zipper closure at the region of the teeth where they are fixed to the bands. However, these stones are not formed in plastic teeth. For stones which are formed in plastic teeth during injection of the teeth, such a displacement of the teeth to the back ends of the teeth where they are fixed to the bands has not been possible until now. It was believed that the injection of the resin has to take place in the immediate proximity of the tips of the decorative stones in the direction of the axis of the stones, if the stones are to retain their positions during injection molding without additional precautions which would lead to intolerable costs.

SUMMARY OF THE INVENTION

It is an object of the invention to provide a zipper closure with decorative stones which are formed in the teeth during injection molding of the teeth close to the back ends of the teeth.

According to the invention this is possible by arranging the stones close to the back ends of the teeth in such a way that the tips of the stones are situated closer to the respective band than is a tangent to the edge bead of the band, which tangent extends parallel to the band.

When the mold halves are closed the band is arranged with a minimal distance to the respective decorative stone such that the position of the stone is not affected by the insertion of the band. During injection molding the injected resin presses the band against the tip of the stone. The band which is squeezed between the mold halves thereby holds the stone in its position while the resin flows laterally around the stone.

For this process it is beneficial if the injection of the resin happens as close as possible at the band. Therefore, in a preferred embodiment of the invention each of the teeth is provided with a recess on a side which lies opposite of the decorative stone of this tooth.

Other advantages, features and additional objects of the present invention will become manifest to those versed in the art upon making reference to the detailed description and the accompanying drawings of a preferred embodiment of the invention which is shown by way of an illustrative example.

DETAILED DESCRIPTION OF THE DRAWINGS

Figure 1:
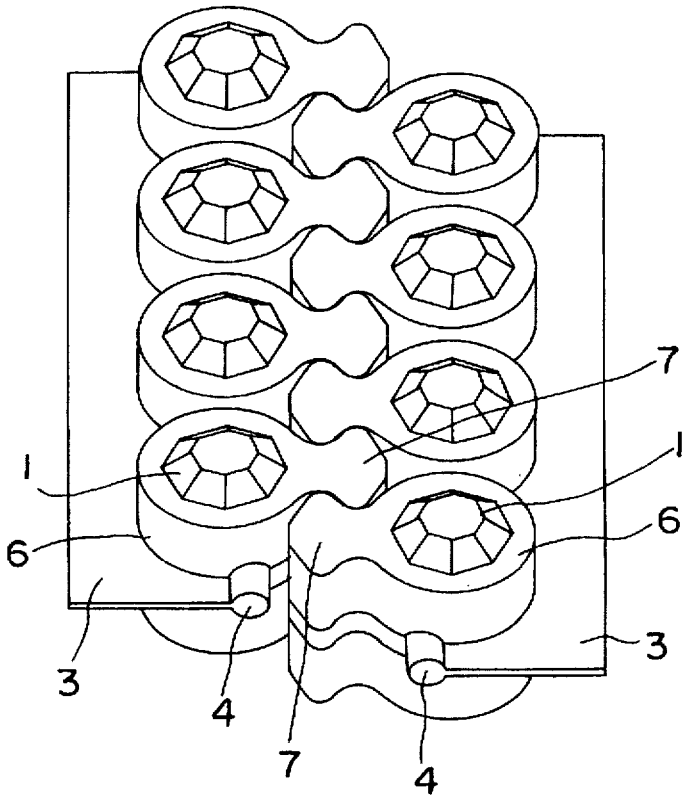
FIG. 1 is a perspective view of an embodiment of a zipper closure according to the invention and FIG. 2 is a cross-sectional view of a tooth.

The zipper closure of FIG. 1 comprises two rows of opposed teeth 6 which are fixed to first and second bands 3. Each band 3, e.g. by being molded onto bands 3 to be integral therewith has an edge bead 4. A mutual engagement of the teeth is produced in a conventional way according to the state of the art.

As the free ends of the teeth 6 do not have to function as holding parts for decorative stones 1, there is a considerable flexibility for designing these portions of the teeth 6. According to the invention the decorative stones 1 are positioned in stone-receiving recesses formed in enlarged portions of the teeth 6 close to the back ends of the teeth, where they are fixed to the bands 3.

Figure 2:
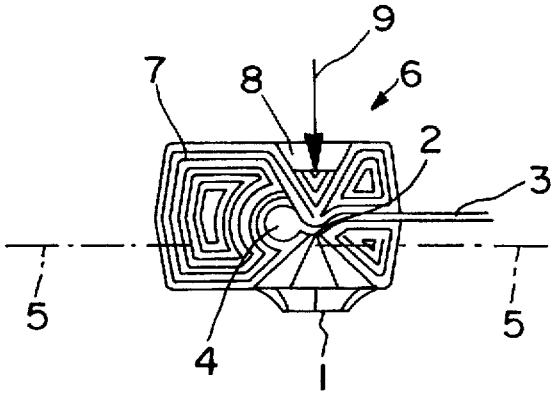

FIG. 2 shows a cross-section through a tooth in the position in which it is produced. The outline of the body depicted in FIG. 2 relates to the cavity of a mold which is divided into two halves in the plane of the band 3. The stones 1 are disposed on the bottoms of the lower mold halves in respective recesses with their tips projecting upwardly such that prior to the injection process a small distance between the tip 2 of the stone 1 and the band 3 is present. Here, a small distance means that the distance between the tip 2 of the stone 1 and the band 3 is smaller than the distance between a tangent 5 and the band 3, which tangent 5 is applied at the edge bead 4 of the band 3 and lies parallel to the band 3.

When the resin is injected in the direction of the arrow 9, at least at the beginning of the injection the band 3 is pressed against the tip 2 of the stone 1 and thereby holds the stone 1 in its position while the injected resin flows around the edge bead 4 and fills the entire cavity of the mold. Because of back recess 8 the place of injection of the resin can be closer to the band 3 as compared to a tooth 6 without such a recess 8, thereby increasing the pressure that the band 3 puts on the tip 2 of the stone 1 during injection. By this, a displacement of the stone 1 during injection of the resin is reliably prevented.

We claim:

1. A zipper closure comprising:

first and second bands, each said band having an edge bead;

first and second rows of plastic teeth molded onto said first and second bands, respectively, to be integral therewith;

each said tooth having a back end fixed to the respective said band and an opposed free end;

each said tooth having in said back end thereof a stone-receiving recess within which is received a decorative stone; and each said stone having a tapered portion with a tip directed toward the respective said band, said tip being closer to said respective band than a plane that is tangent to said bead of said respective band and that extends parallel to said respective band, such that said respective band maintains the position of said stone and prevents displacement thereof during molding.

2. A zipper closure as claimed in claim 1, wherein each said tooth has, in a side thereof opposite said stone-receiving recess, a back recess.

* * * * *